US005527011A

United States Patent [19]

Wiggins et al.

[11] Patent Number: 5,527,011

[45] Date of Patent: Jun. 18, 1996

[54] TREE STAND WITH REMOVABLE LEGS

[76] Inventors: Frederick B. Wiggins; Timothy J. Wiggins; Michael D. Wiggins, all of 2974 London Wall, Bloomsfield Hills, Mich. 48304

[21] Appl. No.: 167,240

[22] Filed: Dec. 15, 1993

[51] Int. Cl.[6] ..... A47G 33/12

[52] U.S. Cl. ..... 248/523; 248/188.7

[58] Field of Search ..... 248/519, 523, 248/524, 529, 188.7, 527; 403/343, 349; 47/40.5

[56] References Cited

U.S. PATENT DOCUMENTS

| | | | |
|---|---|---|---|
| 2,430,840 | 11/1947 | Westfall | 248/529 |
| 2,469,286 | 5/1949 | Wuerl et al. | 248/525 |
| 3,073,558 | 1/1963 | De Klotz | 248/529 X |
| 3,142,464 | 7/1964 | Zelenitz | 47/40.5 |
| 3,353,773 | 11/1967 | Budd | 248/529 X |
| 3,381,635 | 5/1968 | Pforr | 248/519 X |
| 3,411,740 | 11/1968 | Schulz | 248/529 X |
| 4,261,138 | 4/1981 | St. George Syms | 248/523 |
| 4,518,162 | 5/1985 | Oates | 403/349 X |
| 4,565,028 | 1/1986 | Stephan | 248/524 X |
| 4,571,882 | 2/1986 | Capen | 248/524 X |
| 4,801,123 | 1/1989 | Lynch | 248/524 |
| 4,895,339 | 1/1990 | Yang et al. | 248/522 |
| 5,014,461 | 5/1991 | vom Braucke et al. | 47/40.5 |
| 5,074,514 | 12/1991 | Smith | 248/188.7 X |
| 5,121,897 | 6/1992 | Sofy | 47/40.5 X |
| 5,320,323 | 6/1994 | Clark, Jr. | 248/527 X |

*Primary Examiner*—Ramon O. Ramirez
*Attorney, Agent, or Firm*—Michael D. Wiggins

[57] ABSTRACT

A tree stand for engaging a trunk of a tree to support the tree includes a cylindrical support including first and second openings. A base encloses the second opening of the cylindrical support. A connecting device connects the trunk to the base and the cylindrical support through the first opening. A plurality of first connectors extend from one end of the base and the cylindrical support. A plurality of second connectors are located on one end of a plurality of legs. A plurality of first connectors mate with a plurality of second connectors to attach the plurality of legs to the base and the cylindrical support while the tree is in an upright position and resting on the base and the cylindrical support.

15 Claims, 3 Drawing Sheets

TREE STAND WITH REMOVABLE LEGS

BACKGROUND OF THE INVENTION

1. Technical Field

This invention relates to tree stands and, more particularly, to tree stands for supporting a trunk of a tree and including a plurality of legs which can be easily attached and removed while the tree is in an upright position.

2. Discussion

Tree stands are often used for supporting Christmas trees. Some tree stands include a cylindrical base and a plurality of legs extending from the base. Other tree stands are made from molded plastic and include a cylindrical upper base and a circular lower base having a larger diameter than the cylindrical upper base. Both types of stands typically include one or more sets of bolts for engaging the tree trunk. Some of these tree stands also include one or more spikes extending vertically upward from a bottom inner surface of the cylindrical base. The spikes pierce the trunk when the tree is placed on the stand.

Generally, limbs of a lower portion of the tree trunk are removed and the tree is inserted in the base. The bolts are tightened to engage the lower tree trunk. The spikes, if used, prevent the tree from moving within the cylindrical base of the tree stand.

Conventional tree stands, particularly those used with Christmas trees, have several significant disadvantages. First, the tree stands are typically not sturdy and/or stable enough to support the tree. Intentional or accidental movement of the tree limbs often causes the tree to tip. Guy wires are typically used to increase the stability of the tree stands. However, guy wires are aesthetically undesirable and sometimes require holes to be drilled in surrounding walls or ceiling for guy wire anchors.

Tree stands with larger diameter molded bases or tree stands with long fixed legs have also been used to increase the tree stand's stability. However, such tree stands are difficult to store when not in use, in other words approximately eleven out of twelve months a year.

Conventional tree stands are cumbersome and often difficult to attach to the trees, particularly when the tree stand has a large base or long fixed legs. Positioning the tree once the tree is mounted on the stand can also be difficult. Therefore, a tree stand addressing the above problems is desirable.

SUMMARY OF THE INVENTION

A tree stand, according to the present invention, for engaging a trunk of a tree to support the tree includes a cylindrical support including first and second openings. A base encloses the second opening of the cylindrical support. A connecting device connects the trunk to the base and the cylindrical support through the first opening. A plurality of first connectors extend from one of the base and the cylindrical support. A plurality of second connectors are located on one end of a plurality of legs. The plurality of first connectors mate with the plurality of second connectors to attach the plurality of legs. The legs can be attached while the tree is in an upright position and engaged by the connecting device to the base and the cylindrical support.

Other objects, features and advantages will be readily apparent.

BRIEF DESCRIPTION OF THE DRAWINGS

The various advantages of the present invention will become apparent to those skilled in the art after studying the following specification and by reference to the drawings in which.

DESCRIPTION OF THE PREFERRED EMBODIMENT

Figure 1A:
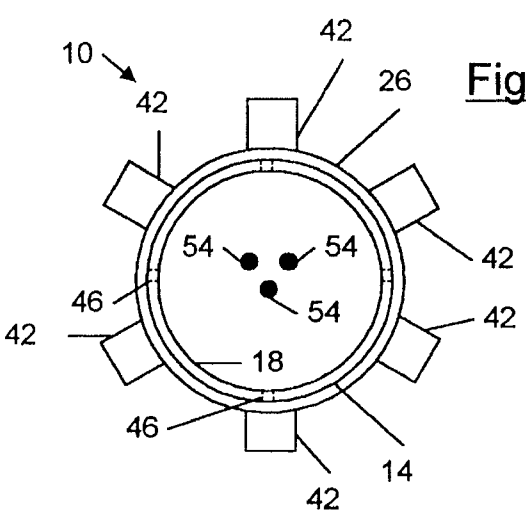
FIG. 1*a* is a plan view of a tree stand according to the present invention.

Referring to FIGS. 1*a,* 1*b,* and 1*c,* a tree stand 10 according to the invention is shown and includes a cylindrical support 14 having an upper opening 18 and a lower opening (not shown). Upper opening 18 of cylindrical support 14 receives the trunk of the tree in use. A base 26 encloses the lower opening of cylindrical support 14. A plurality of legs 30 extend from base 14 and/or from a lower portion 34 of cylindrical support 14, as will be described more fully below.

Figure 1C:
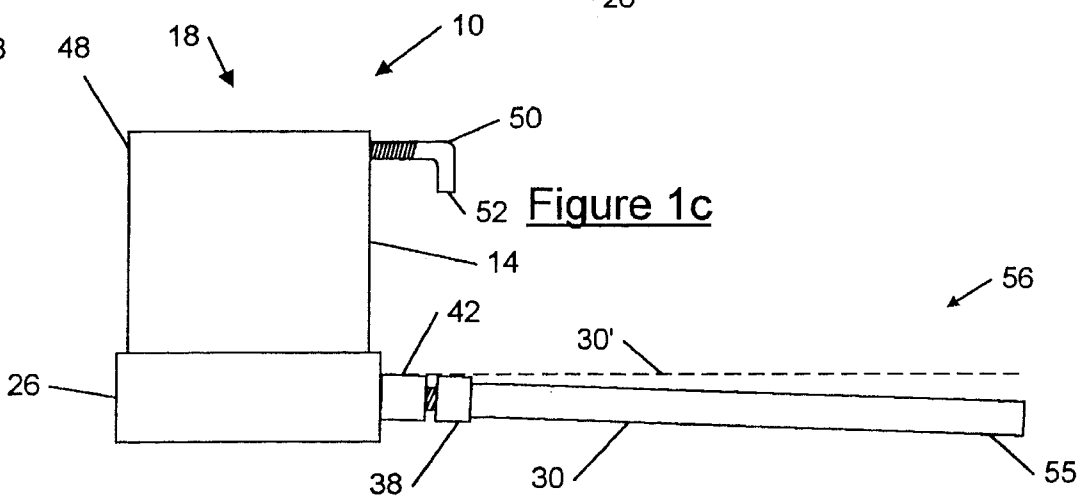
FIG. 1*c* is a side view illustrating a bolt received in the bore and a leg including a mating connector attached to the mating connector connected to the tree stand of FIG. 1*a;*
Figure 1B:
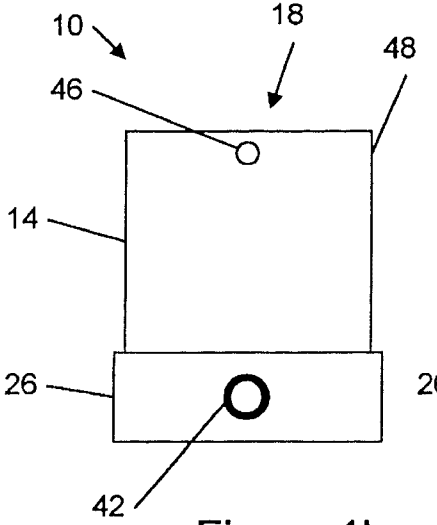
FIG. 1*b* is a side view showing a bore and a mating connector on the tree stand of FIG. 1*a;*

Each leg 30 is attached to base 14 and/or lower portion 34 of the cylindrical support 14 using first and second mating connectors 38 and 42. First mating connector 38 is connected to and/or formed integrally on one end of each leg 30. Second mating connector 42 is connected to or formed integrally on base 26 or lower portion 30 of cylindrical support 14. While legs 30 shown in FIGS. 1*a,* 1*b,* and 1*c* have a circular cross-section, rectangular, square, and other cross-sections can also be utilized. While only one pair of mating connectors 38 and 42 and one leg 30 are shown in FIGS. 1*b* and 1*c* for purposes of clarity, it can be appreciated that additional mating connectors and legs are provided.

A plurality of threaded bores 46 in an upper portion 48 of cylindrical support 14 receive bolts 50 to engage the trunk. Preferably bolts 50 include a handle 52. One or more positioning devices 54 position a bottom end of the tree trunk. Positioning device 54 can include one or more spikes extending from an upwardly facing surface of base 26.

Mating connectors 42 can be attached to base 26 and/or cylindrical support 14 at a slight angle such that when mating connectors 38 (and legs 30) are connected thereto, lower sides 55 of distal ends 56 of legs 30 lie slightly below a downwardly-facing surface 58 defined by base 26. Alternately, mating connectors 42 can be attached perpendicular to cylindrical support 14 as illustrated by dotted lines 30. As can be appreciated, the weight of the tree stand 10 and the tree bias the legs in an upward direction. Slightly preloaded legs 30 provide additional stability.

In use, limbs are removed from a lower portion of the tree trunk. The tree trunk is then inserted through upper opening 18 of cylindrical support 14. Spikes 54 pierce a bottom end of the trunk. Bolts 50 are rotated into the tree trunk, at a point spaced from the bottom end of the trunk, to engage the tree trunk. As can be appreciated, mounting the tree trunk on the tree stand 10 is much easier without legs 30 connected.

The tree, mounted in tree stand 10 without legs 30 attached thereto, can be initially positioned by placing the tree in an upright position and resting the tree and tree stand 10 on cylindrical support 14 and base 26. Thereafter, first mating connectors 38 of legs 30 are attached to second mating connectors 42. Legs 30 can then be used to rotate tree stand 10 to position the tree and display the "ideal" side of the tree. Thereafter, fluids can be added through upper opening 18 into a cavity defined by cylindrical support 14 and/or base 26.

Figure 2A:
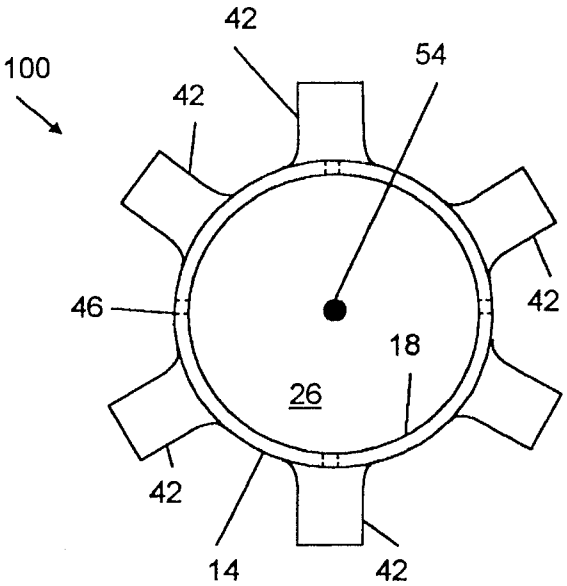
FIG. 2*a* is a plan view of a tree stand including a base, a cylindrical support, and mating connectors which are formed integrally.
Figure 2B:
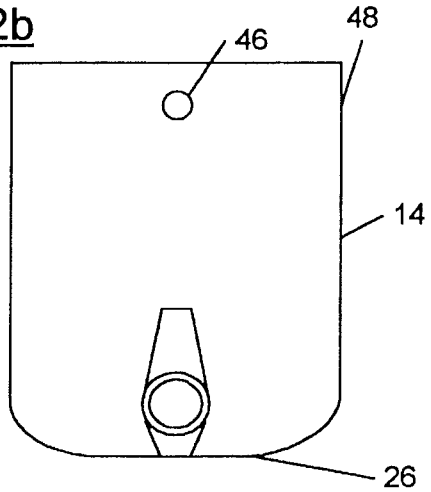
FIGS. 2*b* and 2*c* illustrate side views of the integrated tree stand of FIG. 2*a;*
Figure 2C:
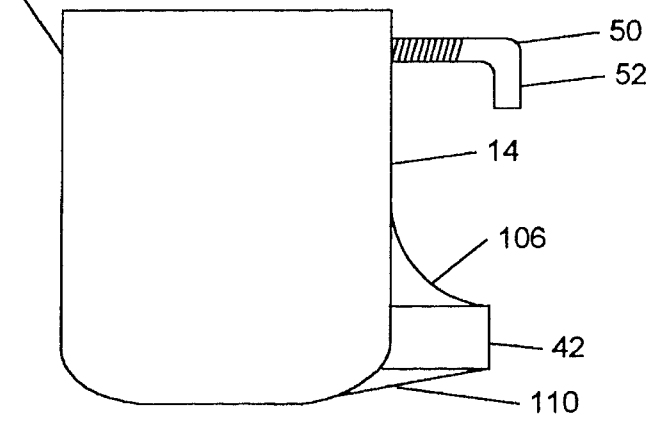

In FIGS. 2*a*, 2*b* and 2*c*, an alternate tree stand 100 according to the invention is shown. For purposes of clarity, reference numbers from FIG. 1 will be used where appropriate. Base 26, cylindrical support 14, and mating connectors 42 are formed integrally, for example, using injection molded plastic. Upper and lower ribs 106 and 110 extend from mating connectors 42 to cylindrical support 14 to increase the strength of mating connectors 42.

Figure 3A:
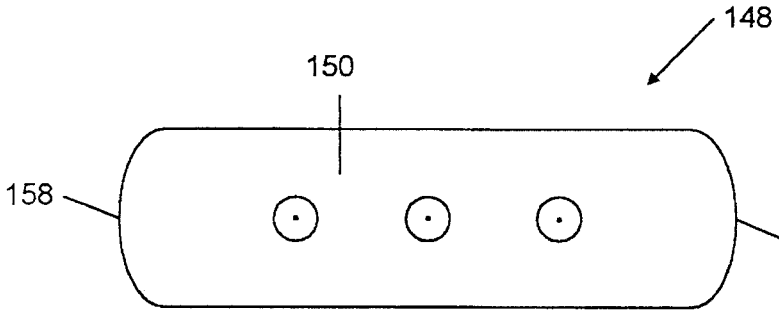
FIGS. 3*a* and 3*b* illustrate a positioning device for engaging a bottom surface of a tree trunk.
Figure 3B:
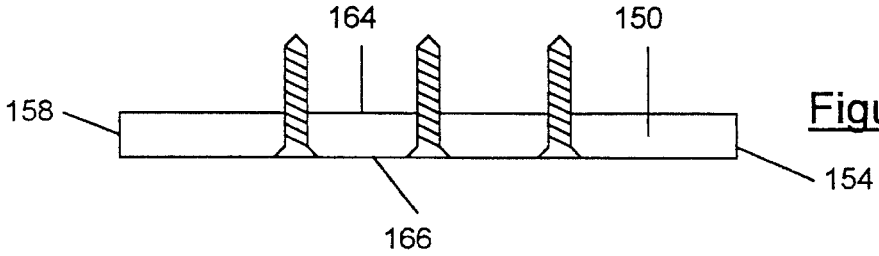

In FIGS. 3*a* and 3*b*, a first alternate positioning device 148 is shown and includes a flat section 150 with arcuate opposing ends 154 and 158. One or more spikes 162, which can be sharpened screws, extend from an upper surface 164 of flat section 150. The screws can be counterbored to provide a flat lower surface 166. When inserted inside the cavity against the upwardly-facing surface of the base, arcuate surfaces 154 and 158 engage inner walls of cylindrical support 14 to prevent movement of the positioning device 148.

Figure 4A:
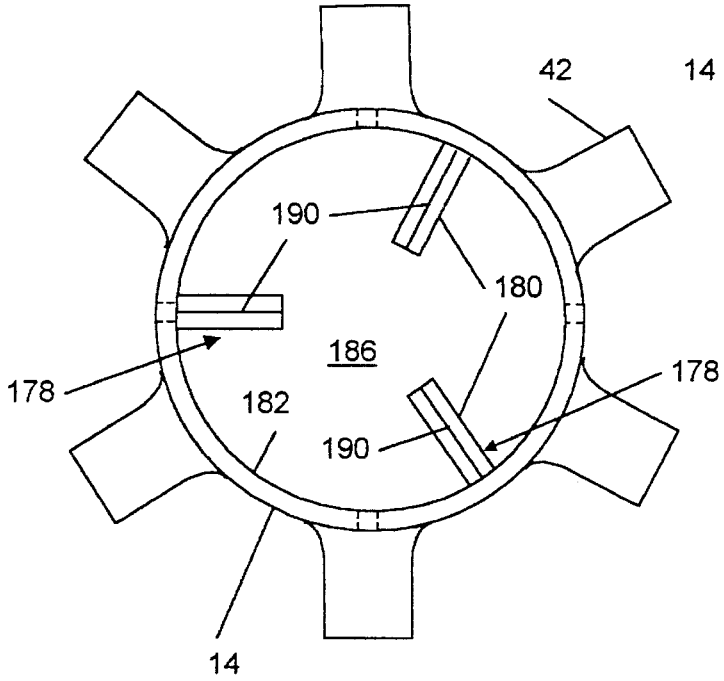
FIGS. 4*a* and 4*b* illustrate an alternate positioning device including a plurality of ribs connected to an inner wall of the cylindrical support and an upwardly facing surface of the base.
Figure 4B:
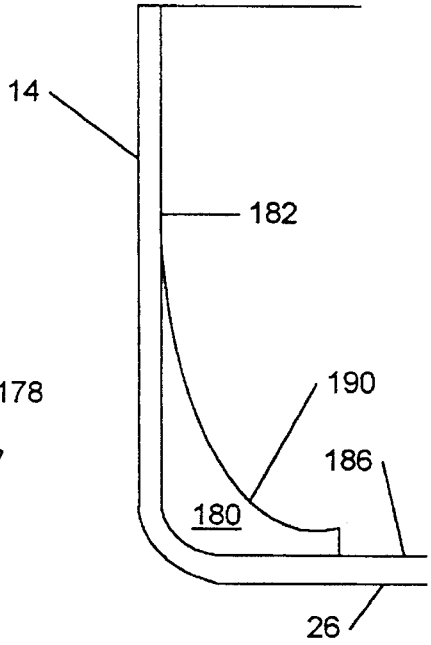

In FIGS. 4*a* and 4*b*, a second alternate positioning device 178 is shown and includes at least three ribs 180 formed on an inner wall 182 of cylindrical surface 14 and an upwardly-facing surface 186 of base 26. As the tree trunk is inserted, the ribs 180 center the base of the tree. Preferably, edges 190 of ribs 180 are sharpened. Other positioning devices will be readily apparent.

First mating connectors 38 can be a female connector and second mating connector 42 can be a male connector. Alternatively, second mating connectors 42 can be a female connector and second mating connector 38 can be a male connector. Mating connectors 38 and 42 can be standard threads, pipe threads, slip-fit, etc.

Figure 5:
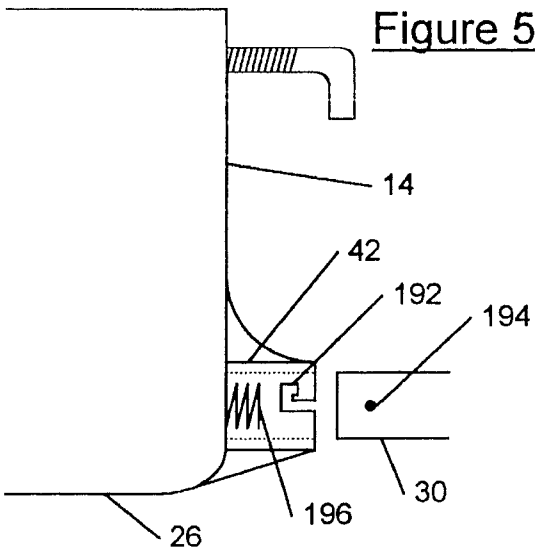
FIG. 5 illustrates alternate first and second mating connectors including a groove, a projection and a spring.

Alternatively, one of the mating connectors 38 and 42 can include one or more grooves 192 and the other of mating connectors 38 and 42 can include one or more projections 194. In FIG. 5, the mating projection 38 of leg 30 includes at least one projection 194 and mating connector 42 includes at least one groove 192. As the leg 30 is connected, projection 194 slides into a locked position with spring 196 biasing the leg in the locked position.

Mating connectors 42 can be plastic female pipe connectors which are connected to base 26 using ultrasonic or vibration welding, friction or spin welding, glue, welding, etc. Mating connectors 38 can be male pipe connectors glued to standard pipe.

Tree stand 10 can be made of steel, brass, aluminum, plastic, etc. Bolts 50 are preferably made of steel and are preferably "L"-shaped or "T"-shaped. Preferably tree stand 10 includes at least five legs.

Cylindrical support 14 can be approximately eight inches tall and can have an inner diameter of approximately six inches. Legs 30 can be approximately two feet long and an have an outer diameter of 1 inch. Tree stands made according to the above-described dimensions can readily support 18 foot trees.

As can be appreciated from the foregoing, tree stands according to the invention are stable and can be manufactured inexpensively. Legs 30 can be removed easily for storage. Legs 30 can be connected after base 26 and cylindrical support 14 are attached to the tree trunk allowing the tree to be tilted into an upright position more readily. Legs 30 are easily connected once the tree is in the upright position. Legs 30 can be used to rotate the tree into an ideal position. By providing at least five legs, the tree is less likely to become unstable, especially during rotation. Legs 30 can be easily removed for storage. Other objects, features and advantages will be readily apparent.

The various advantages of the present invention will become apparent to those skilled in the art after a study of the foregoing specification and following claims.

What is claimed is:

1. A tree stand for engaging a trunk of a tree to support the tree comprising:

a cylindrical support including first and second openings;

a base enclosing the second opening of the cylindrical support;

connecting means for connecting said trunk to the base and the cylindrical support through the first opening;

a plurality of first connectors extending from one of said base and said cylindrical support;

a plurality of detachable legs; and a plurality of second connectors located on one end of said plurality of legs, wherein the plurality of first connectors mate with the plurality of second connectors to attach the plurality of legs to the base and the cylindrical support while said tree is in an upright position with said base and cylindrical support attached to said trunk and at least one of the base and the cylindrical support resting on the ground; and wherein said legs are attached perpendicular to said cylindrical support or at a slight angle from perpendicular with respect to an outer wall of the cylindrical support such that said legs are slightly pre-loaded.

2. The tree stand of claim 1 wherein said cylindrical support and said base are formed integrally.

3. The tree stand of claim 1 wherein said base, said cylindrical support and said first mating connectors are plastic, and wherein said first mating connectors are attached to said one of said base and said cylindrical support using one of ultrasonic welding, plastic glue and friction welding.

4. The tree stand of claim 1 wherein said second mating connectors are formed integrally with said legs.

5. The tree stand of claim 1 wherein said base, said cylindrical support and said first mating connector are made of plastic and are formed integrally using injection molding.

6. The tree stand of claim 1 wherein said connecting means includes a flat section with opposing arcuate edges and at least one spike connected to said flat section, wherein said flat section is inserted into a cavity defined by the base and the cylindrical support with the spike in an upwardly-facing direction to engage a bottom surface of the tree trunk, and wherein said arcuate edges engage inner walls of the cylindrical support.

7. The tree stand of claim 1 wherein one of said first and second mating connectors includes a projection and the other of said first and second mating connectors includes a groove for receiving the projection.

8. The tree stand of claim 7 further comprising a spring for biasing one of the projection and the groove into a locked position.

9. The tree stand of claim 1 wherein said tree stand includes at least five legs.

10. The tree stand of claim 5 further comprising upper and lower ribs connecting said first mating connector to said cylindrical support and said base for reinforcing said first mating connectors.

11. A tree stand for engaging a trunk of a tree to support the tree comprising:

a cylindrical support including first and second openings;

a base enclosing the second opening of the cylindrical support;

connecting means for connecting said trunk to the base and the cylindrical support through the first opening;

a plurality of first connectors extending from one of said base and said cylindrical support;

a plurality of detachable legs; and a plurality of second connectors located on one end of said plurality of legs, wherein the plurality of first connectors mate with the plurality of second connectors to attach the plurality of legs to the base and the cylindrical support while said tree is in an upright position and resting on the base and the cylindrical support; and wherein said legs are attached perpendicular to said cylindrical support or at a slight angle from perpendicular with respect to an outer wall of the cylindrical support such that said legs are slightly preloaded;

wherein said connecting means includes a plurality of bores formed in said cylindrical support adjacent said first opening, wherein said bores receive bolts for engaging the tree trunk.

12. The tree stand of claim 11 wherein said connecting means further includes at least one spike extending vertically from an upwardly-facing surface of the base.

13. The tree stand of claim 11 wherein said connecting means further includes at least three ribs connected to an inner surface of said cylindrical support and said base.

14. A tree stand for engaging a trunk of a tree to support the tree comprising:

a cylindrical support including first and second openings;

a base enclosing the second opening of the cylindrical support;

connecting means for connecting said trunk to the base and the cylindrical support through the first opening;

a plurality of first connectors extending from one of said base and said cylindrical support;

a plurality of detachable legs; and a plurality of second connectors located on one end of said plurality of legs, wherein the plurality of first connectors mate with the plurality of second connectors to attach the plurality of legs to the base and the cylindrical support while said tree is in an upright position and resting on the base and the cylindrical support; and wherein said legs are attached perpendicular to said cylindrical support or at a slight angle from perpendicular with respect to an outer wall of the cylindrical support such that said legs are slightly preloaded;

wherein said first and second mating connectors are threaded.

15. The tree stand of claim 4 wherein said first and second threaded mating connectors are tapered.

* * * * *